US011149740B2

(12) United States Patent
Godo

(10) Patent No.: US 11,149,740 B2
(45) Date of Patent: Oct. 19, 2021

(54) BLOWER

(71) Applicant: SHINANO KENSHI KABUSHIKI KAISHA, Nagano (JP)

(72) Inventor: Shin-ichiro Godo, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 60 days.

(21) Appl. No.: 16/737,075

(22) Filed: Jan. 8, 2020

(65) Prior Publication Data

US 2020/0271122 A1 Aug. 27, 2020

(30) Foreign Application Priority Data

Feb. 25, 2019 (JP) ..... JP2019-031419

(51) Int. Cl.
*F04D 29/28* (2006.01)
*F04D 17/08* (2006.01)

(52) U.S. Cl.
CPC ..... *F04D 29/281* (2013.01); *F04D 17/08* (2013.01)

(58) Field of Classification Search
CPC .... F05D 17/08; F05D 29/281; F05D 29/4206; F05D 29/4226
See application file for complete search history.

(56) References Cited

U.S. PATENT DOCUMENTS 7,186,080 B2 * 3/2007 Smiley, III ..... F04D 29/4213 415/205
9,574,565 B2 * 2/2017 Teramoto ..... F04D 17/08
9,765,788 B2 * 9/2017 Dybenko ..... F04D 29/162
2013/0156569 A1 * 6/2013 Ishikawa ..... F04D 29/162 415/206
2019/0290081 A1 * 9/2019 Yoshino ..... F04D 29/16
2019/0293083 A1 * 9/2019 Ishii ..... F04D 29/281

FOREIGN PATENT DOCUMENTS

JP H-8-200295 8/1996
WO WO-2017104009 6/2017
WO WO-2017/154151 9/2017

OTHER PUBLICATIONS

Office Action dated Nov. 17, 2020 in Japanese Application No. 2019-031419.

* cited by examiner

*Primary Examiner* — Ninh H. Nguyen
(74) *Attorney, Agent, or Firm* — Stephen J. Weyer, Esq.; Stites & Harbison, PLLC

(57) ABSTRACT

There is provided a blower capable of suppressing fluctuation of a flow path and suppressing occurrence of surging in a use rotation range of the blower by changing a shape without increasing the number of parts. A flow path is formed by a first housing-side shroud 3*e* connecting to an intake port 3*a* and an impeller-side shroud 2*c* connecting outer peripheral sides of blades 2*b* being adjacent to each other in a radial direction in a blowing passage 8*a* connecting the intake port 3*a* and a discharge port 8*b*, and a narrow part 16 where a cross-sectional area of the flow path becomes the minimum is provided on an outer side of outer peripheral end portions of the blades 2*b* in the radial direction.

4 Claims, 7 Drawing Sheets

CROSS SECTION X-X

BLOWER

CROSS-REFERENCE TO RELATED APPLICATION

This application is based upon and claims the benefit of priority of the prior Japanese Patent Application No. 2019-031419, filed on Feb. 25, 2019, and the entire contents of which are incorporated herein by reference.

TECHNICAL FIELD

The present invention relates to a blower used for, for example, medical equipment, industrial equipment, consumer equipment and so on.

BACKGROUND ART

In the blower used in the past, reduction in size is required on one hand, and a high pressure, a high flow rate and high responsiveness are required on the other hand due to improvement of required performance. Accordingly, the technique is aiming to reduce a diameter of an impeller and to rotate the impeller at higher speed. However, the requirements such as the high pressure and the high flow rate may cause increase in thrust load due to size increase of a motor and increase in thrust of the impeller, which leads to reduction of the lifetime of a bearing.

In order to reduce the size of the blower, a blowing passage 51 is arranged at a position apart from a motor M in an axial direction (a top housing 52 side) as shown in FIG. 7, which can reduce a diameter of a blower regardless of a motor diameter. This has also an advantage that a thrust in the axial direction acting on an impeller 53 can be reduced.

A shape of the impeller 53 forming the blower is formed so that a flow-path volume is increased from an upstream side to a downstream side in a blowing direction (refer to PTL 1: W)017/154151)

SUMMARY OF INVENTION

Technical Problem

However, blower performance is drastically reduced unless a shroud 54 that separates the impeller 53 and the blowing passage 51 through which compressed air is blown is installed. Moreover, the number of parts is increased as the shroud 54 is installed as a separate part, which increases man-hours for assembly and management.

Furthermore, in a structure in which the impeller 53 is installed in the top housing 52 and a bottom housing 54, surging (backflow of air) may occur depending on conditions of the pressure and the flow rate of discharge air and pressure conditions on an intake side.

There is a danger that the surging causes intermittent pressure fluctuation and flow-rate fluctuation of the blower, which may lead to not only reduction in performance of the blower but also generation of noise.

Solution to Problem

In response to the above issue, one or more aspects of the present invention are directed to a blower capable of suppressing pressure fluctuation of fluid and suppressing occurrence of surging, which is provided by changing the shape without increasing the number of parts.

In view of the above, the following embodiments are described below.

There is provided a blower in which an impeller and a rotor are respectively assembled to a rotor shaft rotatably and pivotally supported inside a housing having a first housing that houses the impeller and a second housing that houses a motor, and outside air is sucked from an intake port provided at a central part in an axial direction inside the first housing by rotation of the impeller and discharged from a discharge port provided on an outer side in a radial direction, wherein a flow path is formed by a first housing-side shroud connecting to the intake port and an impeller-side shroud connecting outer peripheral sides of blades being adjacent to each other in the radial direction in a blowing passage connecting the intake port and the discharge port, and a narrow part where a cross-sectional area of the flow path becomes the minimum is provided on an outer side of outer peripheral end portions of the blades in the radial direction.

As described above, normally in the blower, the flow path is formed so that a cross-sectional area thereof is basically constant from the center of the blades toward outer peripheral end portions in the radial direction and becomes gradually wide from the blowing passage provided on an outer side of outer peripheral end portions of the blades in the radial direction; a narrow part where the cross-sectional area of the flow path becomes the minimum is provided on the outer side of the outer peripheral end portions of the blades in the radial direction, thereby suppressing pressure fluctuation of fluid and suppressing occurrence of surging.

A stepped portion whereby a distance to the impeller-side shroud is shortened may be provided on a flow-path wall surface of the first housing or the second housing facing a flow path surface of the impeller-side shroud. According to the structure, the flow path is formed so that the cross-sectional area thereof is basically constant from the center of the blades toward outer peripheral end portions in the radial direction and becomes gradually wide from the blowing passage provided on the outer side of outer peripheral end portions of the blades in the radial direction normally in the blower; impeller-side shroud approaches the flow-path wall surface of the first housing or the second housing due to the stepped portion, thereby forming the narrow part where the cross-sectional area of the flow path becomes the minimum.

A curved surface portion in which a curvature of the first housing or the second housing is changed may be formed on the flow-path wall surface of the first housing or the second housing facing the flow path surface of the impeller-side shroud. According to the structure, the outer peripheral end portion of the impeller-side shroud approaches the curved surface portion provided on the flow-path wall surface of the first housing or the second housing, thereby forming the narrow part where the cross-sectional area of the flow path becomes the minimum.

An extended portion whereby a distance to the flow-path wall surface of the first housing or the second housing facing the flow path surface of the impeller-side shroud is shortened may be formed at an outer peripheral end portion of the impeller-side shroud. According to the structure, the extended portion of the impeller-side shroud approaches the flow-path wall surface of the first housing or the second housing, thereby forming the narrow part where the cross-sectional area of the flow path becomes the minimum.

Advantageous Effects of Invention

It is possible to provide the blower capable of suppressing pressure fluctuation of fluid and suppressing occurrence of surging by changing the shape without increasing the number of parts.

DESCRIPTION OF EMBODIMENTS

Figure 1:
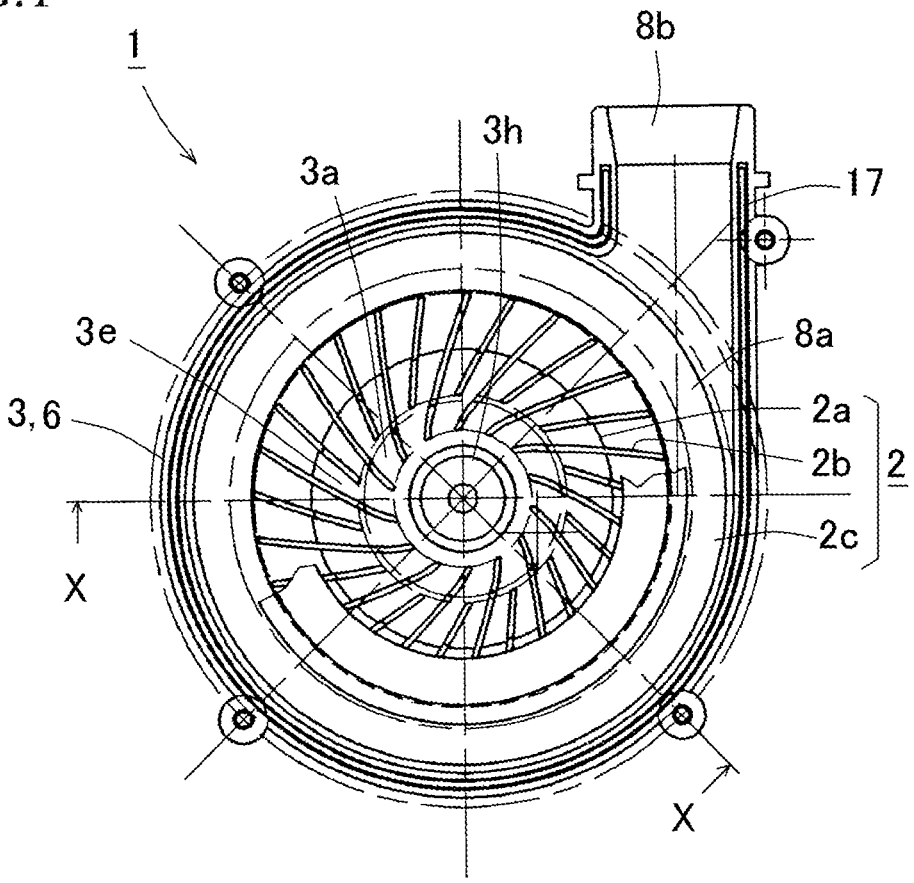
FIG. 1 is a plan view in an axial direction of a blower from which a top housing is removed.

Hereinafter, a blower according to an embodiment of the present invention will be explained with reference to the attached drawings. First, an outline structure of the blower will be explained with reference to FIG. 1 to FIG. 3.

Figure 2:
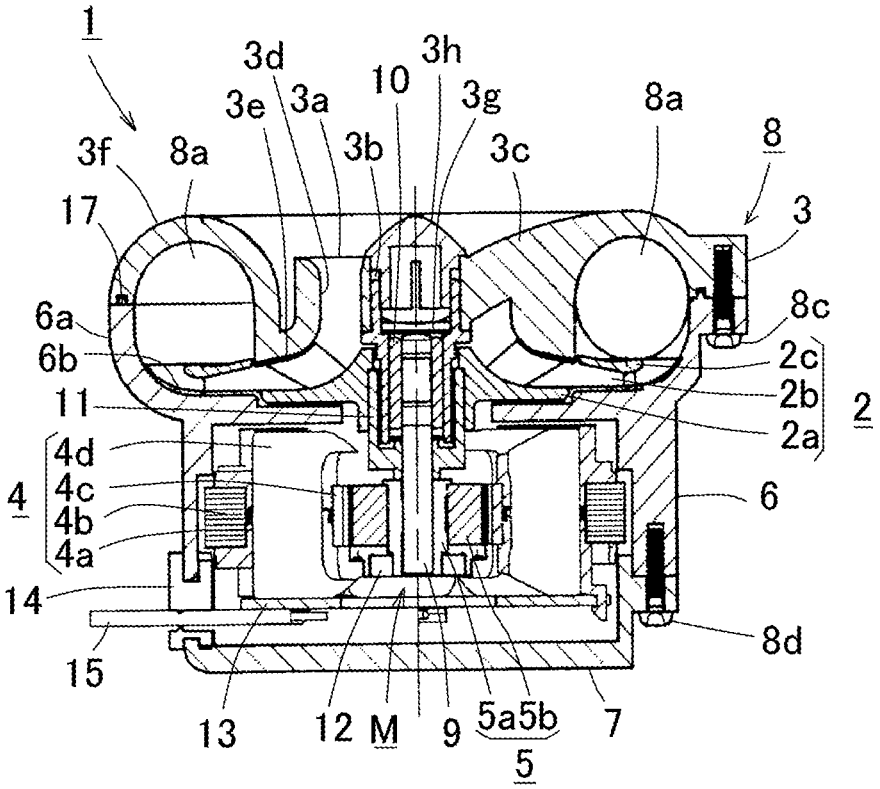
FIG. 2 is a cross-sectional view taken along an arrow X-X direction of the blower shown in FIG. 1.

A blower 1 has the following structure. As shown in FIG. 2, a top housing (first housing) 3 housing an impeller 2 and a bottom housing (second housing) 6 housing a stator 4 and a rotor 5 (a motor M) are integrally screw-fixed by a bolt 8*c*, and a bracket 7 is integrally assembled to a bottom part of the bottom housing 6 by being screw-fixed by a bolt 8*d* to form a case body 8. A seal material 17 is sandwiched at an abutting end surface between the top housing 3 and the bottom housing 6, and a blowing passage 8*a* is assembled in a sealed manner. The impeller 2 and the rotor 5 are respectively assembled with a rotor shaft 9 rotatably and pivotally supported so as to rotate inside the case body 8.

As shown in FIG. 2, a tubular bearing holding portion 3*b* is integrally formed with an intake port 3*a* of the top housing 3 by a plurality of connecting beams 3*c* which are radially formed. A housing-side shroud 3*e* is formed continuously from a tubular opening wall 3*d* that forms the intake port 3*a*. The housing-side shroud 3*e* is arranged so as to correspond to the impeller 2, forming a blowing passage toward an outer side in a radial direction. A top-side curved portion 3*f* is continuously formed from the housing-side shroud 3*e*. In the bottom housing 6 facing the top-side curved portion 3*f*, a bottom-side curved portion 6*a* is provided. The blowing passage 8*a* circling around an outer periphery of the impeller 2 is formed by combination of the top-side curbed portion 3*f* and the bottom-side curved portion 6*a*. Compressed air blowing through the blowing passage 8*a* formed in the case body 8 is discharged from a discharge port 8*b* (see FIG. 1).

As shown in FIG. 2, a bearing 10 pivotally supporting one end side of the rotor shaft 9 is assembled inside the bearing holding portion 3*b*. As the bearing 10, a sliding bearing formed in a tubular shape (for example, a fluid dynamic pressure bearing or the like) is preferably used. One end of the rotor shaft 9 is rotatably supported by the bearing 10 and a shaft end is supported so as to abut on an end cover 3*g* provided at a stepped part inside the bearing holding portion 3*b*. An upper end of the bearing holding portion 3*b* is closed by a top cover 3*h*. In this case, the size can be easily reduced as compared with a case of using a rolling bearing, which can reduce noise and vibration. Moreover, the bearing 10 does not generate heat due to mechanical loss even when a small-sized motor is rotated at high speed; therefore, the air volume can be secured without reducing durability.

The impeller 2 is coaxially assembled to an outer periphery of the bearing holding portion 3*b* through a bearing housing 11. The bearing housing 11 is integrally assembled to the rotor shaft 9 by press fitting, adhesion and so on. The impeller 2 is integrally assembled to the bearing housing 11 by molding, adhesion, press fitting and so on. In the impeller 2, blades 2*b* are formed to stand at plural places on a disc-shaped main plate 2*a* from a central part toward outer peripheral directions (see FIG. 2). An impeller-side shroud 2*c* is integrally molded in a ring shape on the outer peripheral side of the blades 2*b* (see FIG. 1). The impeller-side shroud 2*c* is formed so as to connect upper end portions on the outer peripheral side of the blades 2*b*, which is formed to face a bottom portion 6*b* of the bottom housing 6.

The rotor 5 is assembled to the other end side of the rotor shaft 9. Specifically, a rotor magnet 5*b* is concentrically attached to the rotor shaft 9 through a rotor yoke 5*a*. N-poles and S-poles are alternately magnetized in the rotor magnet 5*b* in a circumferential direction. The rotor 5 is assembled so as not to come off in the axial direction by the rotor yoke 5*a* and a balance correction portion 12 assembled to the end portion of the rotor shaft 9 (see FIG. 2). A sensor magnet is attached to the balance correction portion 12 according to a structure of a motor drive circuit.

In FIG. 2, the motor M is housed in the bottom housing 6. Specifically, the stator 4 is assembled inside the bottom housing 6. An annular core-back portion 4*b* is fixed and a stator core 4*a* is assembled to an inner wall surface of the bottom housing 6. Pole teeth 4*c* are provided to protrude from the annular core-back portion 4*b* to the inner side in the radial direction. Coils 4*d* are wound around respective pole teeth 4*c*. The pole teeth 4*c* of the stator core 4*a* are arranged so as to face the rotor magnet 5*b*. Moreover, a motor substrate 13 is provided in the bottom portion of the bottom housing 6, and coil leads pulled out from respective coils 4*d* are connected thereto.

As shown in FIG. 2, a grommet 14 is attached to an opening formed between end surfaces of the bottom housing 6 and the bracket 7. Lead wires 15 are taken out to the outside through the grommet 14 so that power is fed.

As shown in FIG. 2, when the motor M is activated, the blower 1 sucks outside air into the tubular opening wall 3*d* from the axial direction of the intake port 3*a* of the top housing 3 by the rotation of the impeller 2, then, compressed air is sent from the inner side to the outer side in the radial direction between the main plate 2*a* and the housing-side shroud 3*e* along the blades 2*b* by the rotation of the impeller 2 and passes between the impeller-side shroud 2*c* formed in the ring shape and the bottom portion 6*b* of the bottom housing 6 to be fed into the blowing passage 8*a*. Then, the compressed air circulates around the blowing passage 8*a* and discharged from the discharge port 8*b* of the case body 8 (see FIG. 1). The impeller-side shroud 2*c* and the housing-side shroud 3*e* are connected to form the shroud. The main plate 2*a* of the impeller 2 is arranged on the bottom portion 6*b* of the bottom housing 6. It is desirable that an upper surface of the main plate 2*a* is arranged adjacent to a bottom surface of the bottom housing 6 so as to form a continuous surface in the radial direction. Accordingly, the upper surface of the main plate 2*a* and the bottom surface of the bottom housing 6 make the continuous surface, not a stepped surface; therefore, the flow of air is improved.

An outer edge of the impeller-side shroud 2*c* and an outer edge of the main plate 2*a* are connected by integral molding through the blades 2*b*, which can improve strength of the impeller-side shroud 2*c*.

As shown in FIG. 2, the bearing holding portion 3*b* is integrally formed with the intake port 3*a* of the top housing 3, and the bearing 10 pivotally supporting the rotor shaft 9 is assembled inside the bearing holding portion 3*b*; therefore, the impeller 2 can be coaxially assembled to the outer periphery of the bearing holding portion 3*b*. Accordingly, a length of the rotor shaft 9 can be short, and a dimension in the axial direction of the blower 1 can be reduced. The rotation center of gravity comes close to the bearing 10 as the bearing 10 pivotally supporting the rotor shaft 9 is arranged in the vicinity of the impeller 2 as close as possible; therefore, imbalance of the impeller 2 hardly has an influence as a load, and rotation balance is improved.

Furthermore, air is sucked in the axial direction from the intake port 3*a* of the top housing 3 when the motor M is activated and the impeller 2 is rotated; therefore, heat generation of the bearing 10 due to mechanical loss is cooled by the intake. As a result, temperature increase in the bearing 10 is suppressed, which contributes to suppression of oil deterioration; therefore, durability can be improved. The bearing 10 is assembled to the bearing holding portion 3*b* provided in the intake port 3*a*; however, the arrangement of the bearing 10 is not limited to this, and for example, the bearing 10 may also be arranged apart from the impeller 2 in the axial direction.

As shown in FIG. 2, the rotor 5 is assembled to the other end side of the rotor shaft 9. Specifically, the rotor magnet 5*b* is attached to the rotor shaft 9 through the rotor yoke 5*a* so as not to come off by the balance correction portion 12 provided at the shaft end portion. The rotor magnet 5*b* is arranged to face the pole teeth 4*c* of the stator core 4*a* held in the bottom housing 6. Accordingly, the bearing on the motor M side is omitted and the shaft length of the rotor shaft 9 is shortened as well as the rotation center of gravity is brought close to the bearing 10, as a result, rotation balance is achieved easily.

A flow path is formed from the intake port 3*a* of the top housing 3 by allowing top surface portions of the housing-side shroud 3*e* and the impeller-side shroud 2*c* continued from the housing-side shroud 3*e* facing the blowing passage to be adjacent to each other in the radial direction. As part of the shroud (impeller-side shroud 2*c*) is integrally formed with the impeller 2 as described above, it is not necessary to provide a shroud for separating the intake port 3*a* and the blowing passage 8*a* in the top housing 3 as a separate part; therefore, output performance can be maintained while reducing the number of parts of the blower 1.

Moreover, the impeller-side shroud 2*c* is integrally molded in a ring shape so as to connect outer peripheral end portions of the blades 2 in the ring shape and to be apart from the main plate 2*a*. For example, an outer edge portion of the main plate 2*a* is preferably arranged at a mold separation position which can be integrally molded with the impeller-side shroud 2*c*. Accordingly, when the impeller 2 is resin-molded, the impeller-side shroud 2*c* can be integrally molded with the main plate 2*a* and the blades 2*b* on the outer peripheral side, which can not only reduce the number of parts but also improve mass productivity and assemblability.

Figure 3:
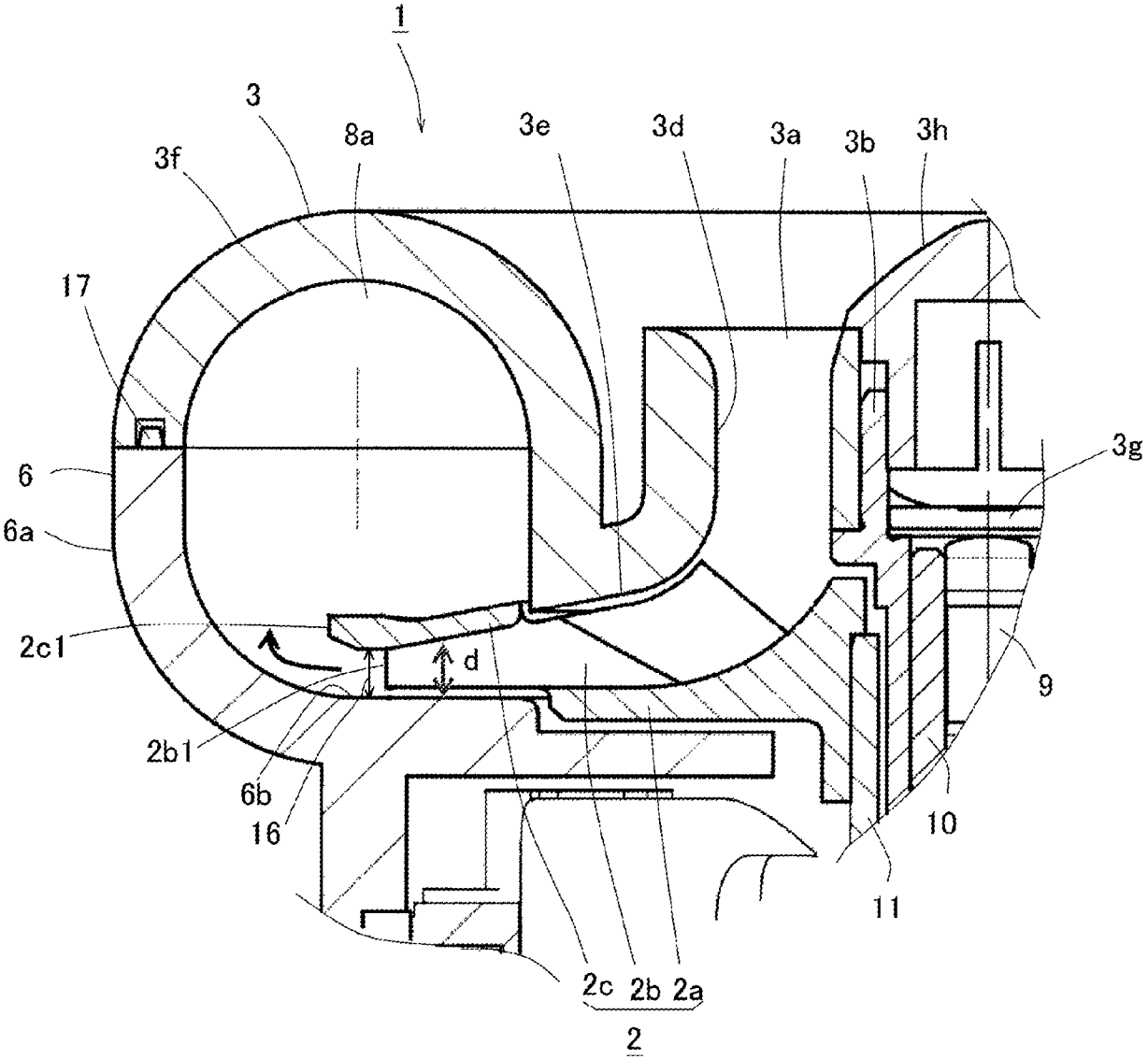
FIG. 3 is a partially enlarged cross-sectional view of FIG. 2.

Here, a structure for suppressing occurrence of surging in a use rotation range of the blower 1 will be explained. In FIG. 3, normally in the blower 1, the flow path is formed so that a cross-sectional area thereof is basically constant from the center of the blades 2*b* toward outer peripheral end portions in the radial direction and becomes gradually wide from the blowing passage provided on an outer side of outer peripheral end portions 2*b* 1 of the blades 2*b* in the radial direction; a narrow part 16 where the cross-sectional area of the flow path becomes the minimum is provided on the outer side of the outer peripheral end portions 2*b* 1 of the blades 2*b* in the radial direction (for example, between the outer peripheral end portions 2*b* 1 of the blades 2*b* and an outer peripheral end portion 2*c* 1 of the impeller-side shroud 2*c*). The narrow part 16 normally indicates a portion where a dimension "d" as a sum of a height of the blade 2*b* and a clearance between the blade 2*b* and the bottom portion 6*b* of the bottom housing 6 is the minimum, which corresponds to a height of the flow path in the axial direction in which fluid flows through the impeller 2. In the embodiment, a part where a value of the dimension "d" is the minimum between the outer peripheral end portions 2*b* 1 of the blades 2*b* and the outer peripheral end portion 2*c* 1 of the impeller-side shroud 2*c* is the narrow part 16. The narrow part 16 may exist over the entire circumference of the bottom housing 6 as well as may be exist partially. Accordingly, pressure fluctuation of fluid can be suppressed and occurrence of surging in the use rotation range can be suppressed by changing the shape without increasing the number of parts as described later.

Figure 4:
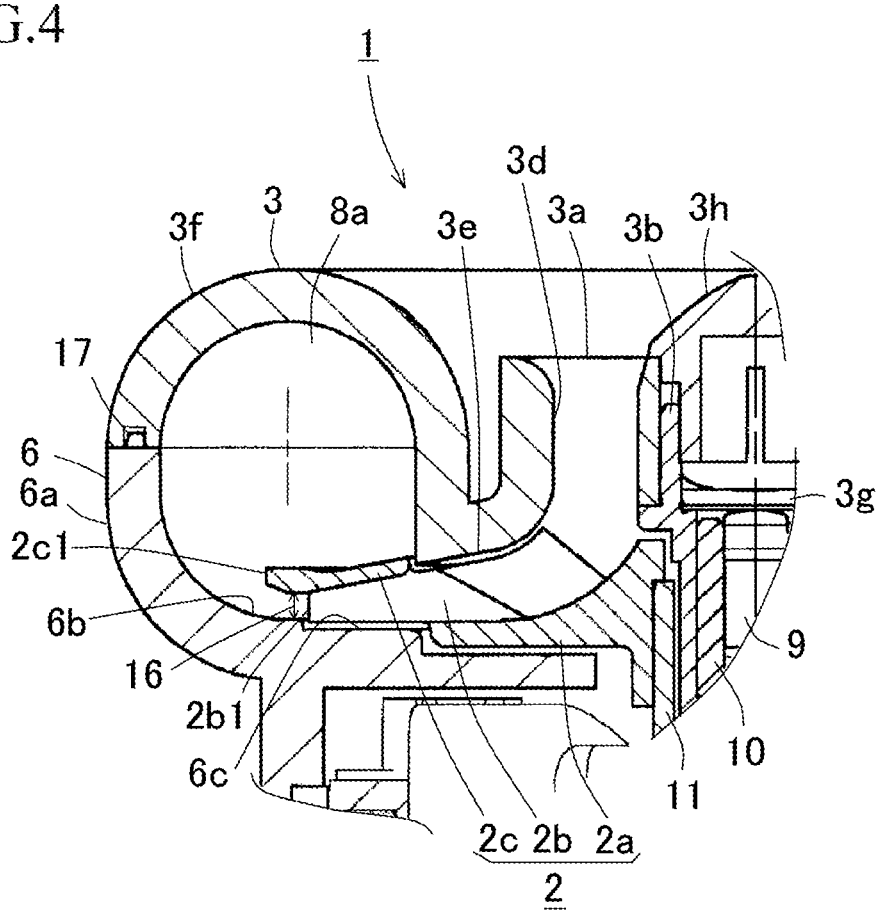
FIG. 4 is a partially enlarged cross-sectional view of a blower provided with a stepped portion according to another example.
Figure 5B:
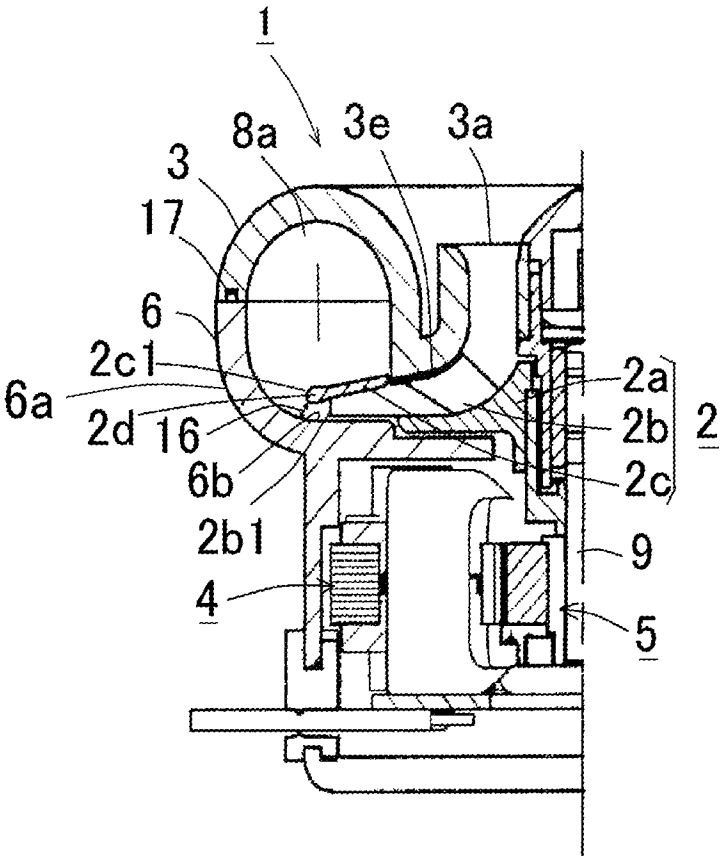
FIGS. 5A and 5B show a partially enlarged cross-sectional view of a blower provided with a curved surface portion and a partially enlarged cross-sectional view of a blower provided with an extended portion according to another examples.
Figure 5A:
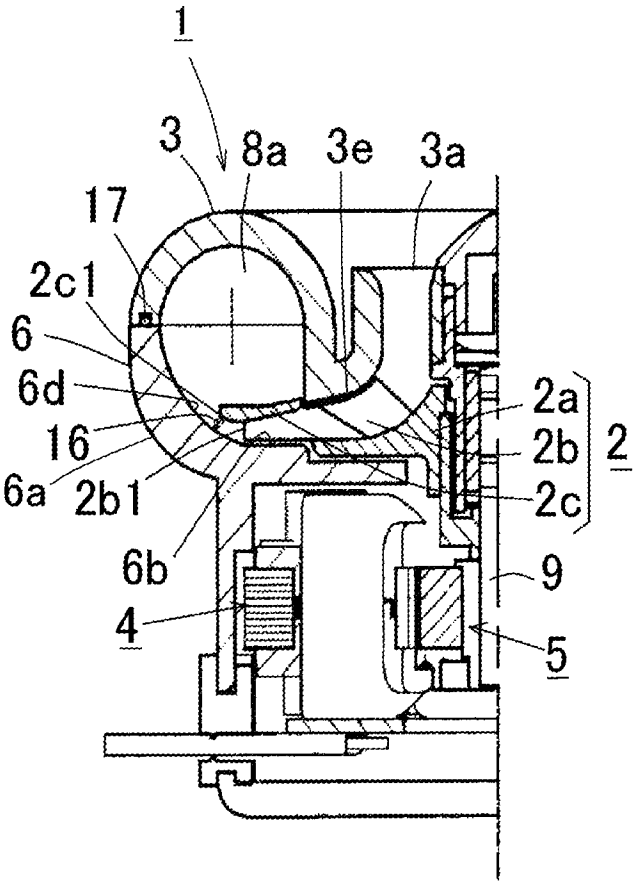

FIG. 4, and FIGS. 5A and 5B show partial cross-sectional views of the housing-side shroud and a tip end portion of the blade according to another example. FIG. 4 shows a structure in which a stepped portion 6*c* whereby the impeller-side shroud 2*c* approaches is provided on a flow-path wall surface (bottom portion 6*b*) of the bottom housing 6 facing a flow path surface of the impeller-side shroud as an example.

In FIG. 4, it is desirable that the upper surface of the main plate 2*a* of the impeller 2 and the bottom portion 6*b* of the bottom housing 6 form the continuous surface, not the stepped surface; however, the stepped portion 6*c* may be provided on the bottom portion 6*b*. In this case, the upper surface of the main plate 2*a* is preferably positioned to be higher than the bottom portion 6*b* (stepped portion 6*c*) of the bottom housing 6. Accordingly, the air flow is not interfered with by the stepped portion 6*c*.

Accordingly, the flow path is formed so that the cross-sectional area thereof is basically constant from the center of the blades 2*b* toward outer peripheral end portions in the radial direction and becomes gradually wide from the blowing passage provided on the outer side of outer peripheral end portions 2*b*1 of the blades 2*b* in the radial direction normally in the blower 1; the height of the blade 2*b* in the axial direction is absorbed by the stepped portion 6*c* and the impeller-side shroud 2*c* approaches the bottom portion 6*b* of the bottom housing 6 on the outer side of the outer peripheral end portions 2*b*1 of the blades 2*b* to form the narrow part 16 where the cross-sectional area of the flow path becomes the minimum.

FIG. 5A shows a structure in which a curved surface portion 6*d* with a small curvature is formed on a curved flow-path wall surface connecting to the bottom portion 6*b* of the bottom housing 6 forming the blowing passage 8*a* as an example. The curved surface portion 6*d* is formed to have a smaller curvature than that of a flow-path wall surface of the bottom-side curved portion 6*a*. The curved surface portion 6*d* may be formed by the bottom housing 6 or may be formed by another member. In the case where the curved surface portion 6*d* is formed by another member, a curved surface member made of a resin material or the like is adhered to the flow-path wall surface connecting to the bottom portion 6*b* of the bottom housing 6 to change the curvature so as to be different from the flow-path wall surface, thereby forming the narrow part 16. The curved surface member may exist over the entire circumference of the bottom housing 6 or may exist partially.

FIG. 5B shows a structure in which an extended portion 2*d* whereby a distance to the flow-path wall surface of the bottom housing 6 is shortened is formed in the impeller-side shroud 2*c* as an example. As the flow-path wall surface connecting to the bottom portion 6*b* of the bottom housing 6 (the bottom-side curved portion 6*a*) is curved, the narrow part 16 in which the cross-sectional area of the flow path becomes the minimum is formed close to the flow-path wall surface of the bottom-side curved portion 6*a* when the extended portion 2*d* is formed at a tip-end outer peripheral portion of the impeller-side shroud 2*c*. Though a shape of the extended portion is arbitrary, it is preferable that a plate thickness of the impeller-side shroud 2*c* is formed to be thicker toward the tip-end outer peripheral portion as shown in FIG. 5B. The embodiment in which the narrow part 16 is provided on the bottom housing 6 side has been explained in the above explanation; however, the narrow part 16 may be provided on the top housing 3 side according to the structure of the blower 1.

Figure 6A:
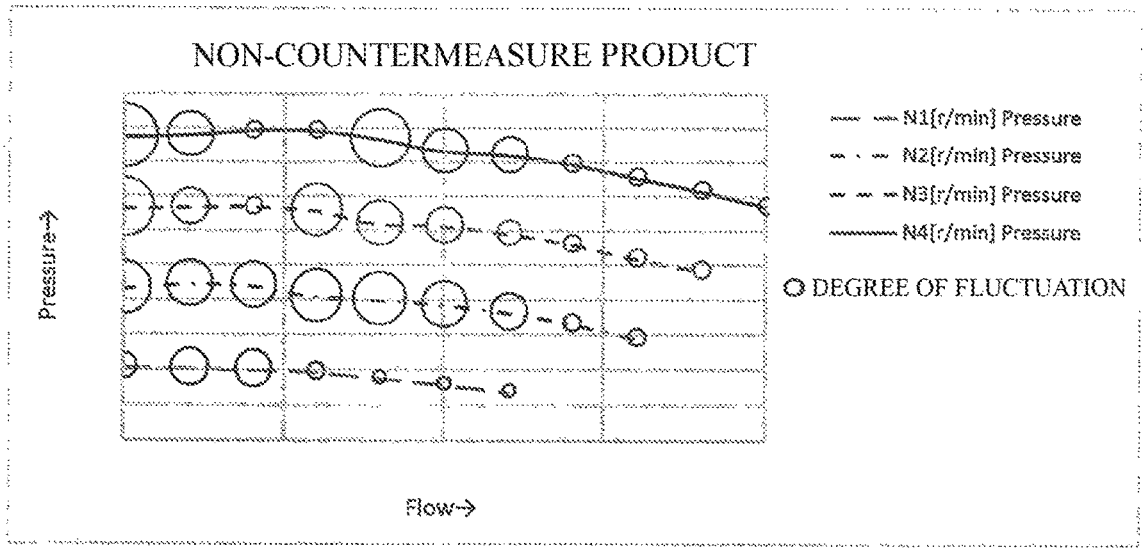
FIGS. 6A and 6B are graphs showing PQ characteristics (pressure—flow rate characteristics) and the degree of pressure fluctuation (surging) at respective operation points in a case where the stepped portion is provided on a bottom portion of a bottom housing and in a case where the stepped portion is not provided.
Figure 6B:
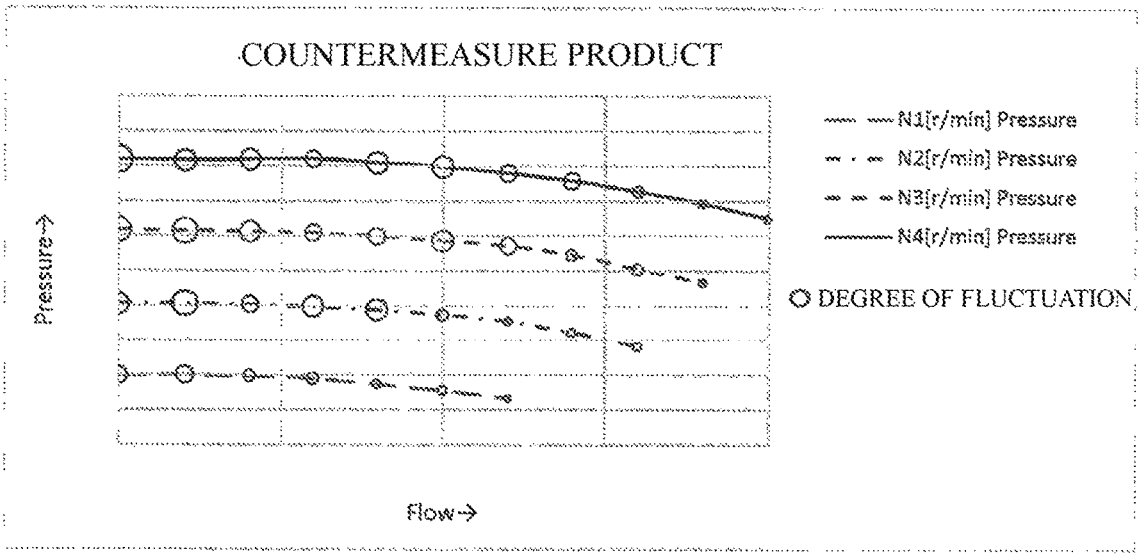
Figure 7:
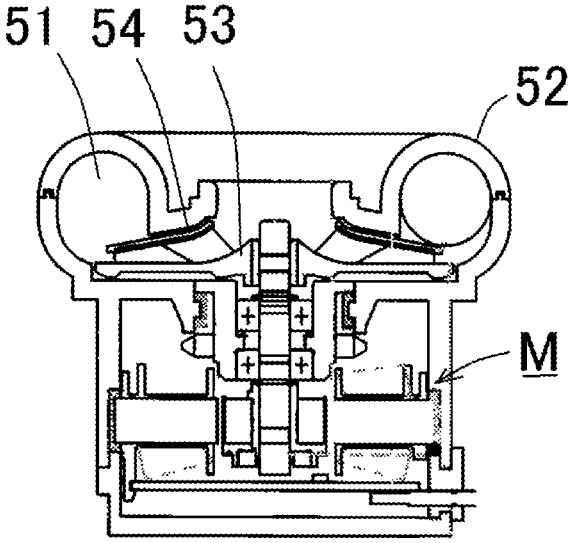
FIG.7 PRIOR ART
FIG. 7 is a cross-sectional view of a related-art blower.

FIGS. 6A and 6B are graphs showing PQ characteristics (pressure—flow rate characteristics) and the degree of pressure fluctuation (surging) at respective operation points in a case where the stepped portion 6*c* is provided on the bottom portion 6*b* of the bottom housing 6 (see FIG. 4) and in a case where the stepped portion 6*c* is not provided. FIG. 6A is a graph in which magnitudes of pressure fluctuation at respective points are expressed by sizes of circles on PQ characteristics of a non-countermeasure product not having the stepped portion when the rotation speed of the motor M is N1 (*rpm*), N2 (*rpm*), N3 (*rpm*) and N4 (rpm). Similarly, FIG. 6B is a graph in which magnitudes of pressure fluctuation at respective points are expressed by sizes of circles on PQ characteristics of a countermeasure product having the stepped portion of 0.5 mm when the rotation speed of the motor M is N1 (*rpm*), N2 (*rpm*), N3 (*rpm*) and N4 (*rpm*). Magnitudes of the rotation speed are N1<N2<N3<N4, and prescribed rotation speeds with in a range of 15000 [rpm] to 40000 [rpm] are used for comparison as an example.

In FIGS. 6A and 6B, a reduction of 75% in pressure fluctuation at the maximum is recognized in the countermeasure product when the rotation speed of the motor M is N1 [rpm], and a difference is not recognized therebetween; however, it is found that the pressure fluctuation can be suppressed 85% at the maximum in N2 [rpm], 75% at the maximum in N3 [rpm], and 70% at the maximum in N4 [rpm]. The larger the pressure fluctuation of fluid is, the larger the noise becomes; therefore, the noise can be reduced in the countermeasure product.

As described above, normally, the flow path is formed so that the cross-sectional area thereof is basically constant from the center of the blades 2*b* toward outer peripheral end portions in the radial direction and becomes gradually wide toward the blowing passage provided on the outer side of outer peripheral end portions of the blades in the radial direction; the narrow part 16 where the cross-sectional area of the flow path becomes the minimum is provided on the outer side of the outer peripheral end portions of the blades 2*b* in the radial direction, thereby suppressing pressure fluctuation of fluid and suppressing occurrence of surging.

Though the fluid dynamic pressure bearing is cited as an example of the bearing 10, the bearing is not limited to this. Other sliding bearings such as a sintered oil retaining bearing may be used. Furthermore, other bearings such as the rolling bearing may be used according to use application, not limited to the sliding bearings.

What is claimed is:

1. A blower in which an impeller and a rotor are respectively assembled to a rotor shaft rotatably and pivotally supported inside a housing having a first housing that houses the impeller and a second housing that houses a motor, and outside air is sucked from an intake port provided at a central part in an axial direction inside the first housing by rotation of the impeller and discharged from a discharge port provided on an outer side in a radial direction, wherein a blowing passage connecting the intake port and the discharge port includes a flow path and a narrow part, the flow path is formed between (i) a first housing-side shroud connecting to the intake port and an impeller-side shroud connecting outer peripheral sides of blades, and (ii) the second housing, the second housing extended on a radial outer side of outer peripheral end portions of the blades and facing the first housing-side shroud and the impeller-side shroud, and the narrow part has a smallest cross-sectional area of the flow path, the cross-sectional area defined by a distance between a flow path surface of the impeller-side shroud and an opposing flow-path wall surface of the second housing.

2. The blower according to claim 1, further comprises a stepped portion provided on a flow-path wall surface of the second housing facing a flow path surface of the impeller-side shroud, thereby reducing the cross-sectional area of the flow-path.

3. The blower according to claim 1, wherein a curved surface portion in which a curvature of or the second housing is changed is formed on the flow-path wall surface of the second housing facing the flow path surface of the impeller-side shroud.

4. The blower according to claim 1, wherein an extended portion whereby a distance to the flow-path wall surface of the second housing facing the flow path surface of the impeller-side shroud is shortened is formed in an outer peripheral end portion of the impeller-side shroud.

* * * * *